US007190279B2

(12) United States Patent
Atris et al.

(10) Patent No.: US 7,190,279 B2
(45) Date of Patent: Mar. 13, 2007

(54) AUDIO MODULATED LIGHT SYSTEM FOR PERSONAL ELECTRONIC DEVICES

(75) Inventors: Youssef H. Atris, Gilbert, AZ (US); Brandt Braswell, Chandler, AZ (US); Brian E. Chang, Gilbert, AZ (US); Gordon P. Lee, Gilbert, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 177 days.

(21) Appl. No.: 11/063,957

(22) Filed: Feb. 22, 2005

(65) Prior Publication Data

US 2006/0197673 A1 Sep. 7, 2006

(51) Int. Cl.
*G08B 5/00* (2006.01)
*G08B 5/22* (2006.01)

(52) U.S. Cl. ..... 340/815.46; 340/691.1; 340/691.6; 455/566

(58) Field of Classification Search ..... 340/815.46, 340/691.6, 691.1, 691.2, 815.4, 815.45; 315/129, 315/131, 133; 455/403, 566, 567
See application file for complete search history.

(56) References Cited

U.S. PATENT DOCUMENTS 5,461,188 A * 10/1995 Drago et al. ..... 84/600
6,046,724 A * 4/2000 Hvass ..... 345/600
6,696,631 B2 2/2004 Smith et al.
2002/0154773 A1 10/2002 Standard et al.
2002/0154787 A1* 10/2002 Rice et al. ..... 381/124
2003/0057884 A1 3/2003 Dowling et al.
2003/0167908 A1 9/2003 Nishitani et al.
2004/0020999 A1 2/2004 Beidokhti
2006/0038498 A1* 2/2006 Maurer et al. ..... 315/123

FOREIGN PATENT DOCUMENTS

WO WO/2003042969 A1 5/2003
WO WO/2003067934 A2 8/2003
WO WO/2003067934 A3 8/2003

* cited by examiner

*Primary Examiner*—Toan N. Pham
(74) *Attorney, Agent, or Firm*—Ingrassia Fisher & Lorenz

(57) ABSTRACT

A light modulation system as described herein can be incorporated into a personal or portable electronic apparatus such as a cellular telephone, a digital music player, or the like. The light modulation system controls the activation of light elements, such as light emitting diodes, of the host electronic apparatus in response to one or more analog audio signals available at the host electronic apparatus. The analog audio signals may be obtained from any suitable analog audio path or source in the host electronic apparatus. The light modulation system is compact, inexpensive to implement, and need not rely on digital signal processors for operation.

19 Claims, 3 Drawing Sheets

200

AUDIO MODULATED LIGHT SYSTEM FOR PERSONAL ELECTRONIC DEVICES

TECHNICAL FIELD

The present invention relates generally to electronic systems, circuits and devices. More particularly, the present invention relates to a system for modulating light elements on a personal electronic device using analog audio signals of the personal electronic device.

BACKGROUND

Lighting capability in portable electronic products (such as cellular telephones, digital music players, and personal digital assistants) is an increasingly desirable feature. In addition to the usual liquid crystal display ("LCD") and keypad backlighting requirements, lighting patterns can be used as visual feedback to the user to convey incoming calls, distinguish Caller ID assignments, and provide phone system status. An emerging area of commercial interest focuses on product differentiation by way of aesthetic lighting enhancements.

One light enhancement approach utilizes digital signal processing of an audio signal to generate a lighting pattern for the light elements in the portable electronic product. In a practical system, this approach requires the audio signal to be ported into the system in the digital domain. The requirements for a dedicated digital signal processor ("DSP") algorithm to handle audio data make this approach less desirable due to the associated cost, complexity, and physical space limitations (assuming a DSP is not already available in the portable electronic product). Additionally, the requirement for processed audio to be injected in the digital domain makes this approach more restrictive, and system architectures that have auxiliary analog inputs would need additional analog-to-digital conversion capability.

Accordingly, it is desirable to have a simple, low cost system that modulates lighting elements of a portable electronic apparatus using analog audio signals utilized by the portable electronic apparatus. It is also desirable to implement a lighting element modulation system without requiring a DSP. In addition, it is desirable to implement a lighting element modulation system as an integrated device that is easily adaptable to the audio signal flow of common electronic devices such as cellular telephones and digital music players. Furthermore, other desirable features and characteristics of the present invention will become apparent from the subsequent detailed description and the appended claims, taken in conjunction with the accompanying drawings and the foregoing technical field and background.

BRIEF DESCRIPTION OF THE DRAWINGS

A more complete understanding of the present invention may be derived by referring to the detailed description and claims when considered in conjunction with the following figures, wherein like reference numbers refer to similar elements throughout the figures.

DETAILED DESCRIPTION

Figure 1:
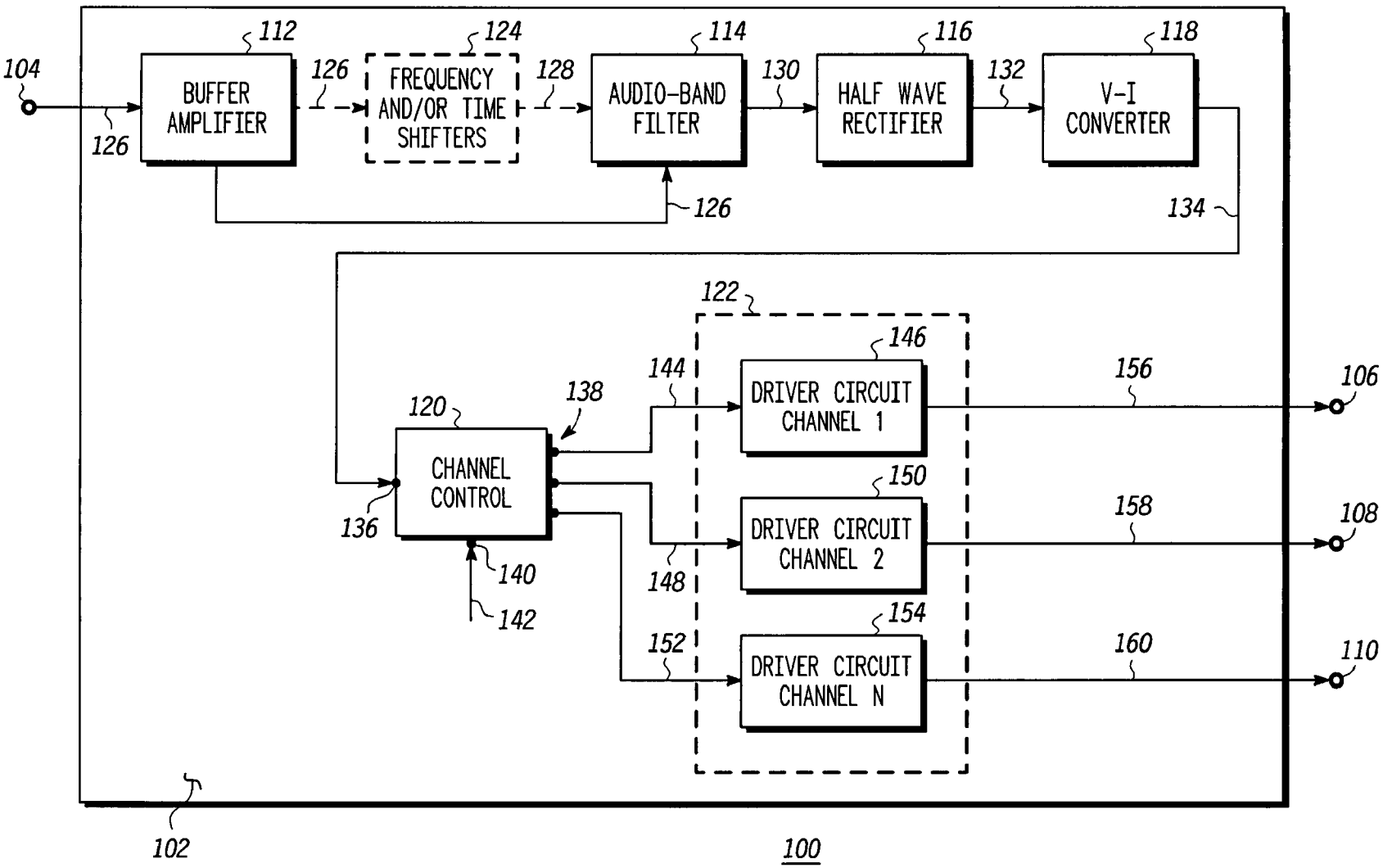
FIG. 1 is a schematic representation of an electronic device for audio modulation of display elements, according to an example embodiment of the invention.

The following detailed description is merely illustrative in nature and is not intended to limit the invention or the application and uses of the invention. Furthermore, there is no intention to be bound by any expressed or implied theory presented in the preceding technical field, background, brief summary or the following detailed description.

The invention may be described herein in terms of functional and/or logical block components and various processing steps. It should be appreciated that such block components may be realized by any number of hardware, software, and/or firmware components configured to perform the specified functions. For example, an embodiment of the invention may employ various integrated circuit components, e.g., memory elements, timing elements, logic elements, look-up tables, or the like, which may carry out a variety of functions under the control of one or more microprocessors or other control devices. In addition, those skilled in the art will appreciate that the present invention maybe practiced in conjunction with any number of practical electronic product platforms and that the systems described herein are merely example applications for the invention.

For the sake of brevity, conventional techniques related to audio signal processing, digital switching and multiplexer control, light emitting diode ("LED") driving, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in a practical embodiment.

As used herein, a "node" means any internal or external reference point, connection point, junction, signal line, conductive element, or the like, at which a given signal, logic level, voltage, data pattern, current, or quantity is present. Furthermore, two or more nodes may be realized by one physical element (and two or more signals can be multiplexed, modulated, or otherwise distinguished even though received or output at a common mode).

The following description may refer to nodes or features being "connected" or "coupled" together. As used herein, unless expressly stated otherwise, "connected" means that one node/feature is directly or indirectly connected to another node/feature, and not necessarily mechanically. Likewise, unless expressly stated otherwise, "coupled" means that one node/feature is directly or indirectly coupled to another node/feature, and not necessarily mechanically. Thus, although the schematics shown in the figures depict example arrangements of elements, additional intervening elements, devices, features, or components may be present in an actual embodiment (assuming that the functionality of the system is not adversely affected).

Personal and/or portable electronic devices are becoming increasingly popular with users of all ages. Personal/portable electronic devices include, without limitation: wireless telephones; personal digital assistants ("PDAs"); pagers; digital music players; handheld computing devices; handheld video games; toys; and the like. Such devices typically include a display architecture, which may include any number of individual display elements that activate in response to certain operations, states, conditions, or functions of the devices. For example, a display architecture may include, without limitation: one or more light elements such as LEDs; LCD elements; or the like. In accordance with one aspect of the invention, such display architectures can be utilized for aesthetic purposes in addition to their usual utilitarian purposes. For example, cellular phones and other products that include audio oriented features such as audio transmit/recording, music playback, alert/ring tones, or gaming can be enhanced with audio coupling and modulation of system lighting. Simply put, a system as described below is preferably configured to capture an audio envelope of the host electronic product, process the audio envelope, and modulate one or more light elements of the host electronic product in response to the processed audio envelope.

As described in more detail below, a practical and simple analog audio modulation system may include a switched capacitor low pass filter, a half-wave rectifier, and a transconductance amplifier (also referred to as a "Gm amplifier") to modulate the LEDs of the host electronic apparatus. The modulation system is designed to improve the integration capability, reduce system cost and processing requirements, and provide a more flexible solution that accommodates a variety of input options by processing the signals in the analog domain.

FIG. 1 is a schematic representation of an electronic device 100 for audio modulation of display elements. Electronic device 100 is configured in accordance with one example embodiment of the invention. In practice, electronic device 100 can be manufactured as a semiconductor device formed on a single circuit board or semiconductor substrate 102. Accordingly, the various block components depicted in FIG. 1 are preferably formed on semiconductor substrate 102 to form an integrated device package that can be installed in a portable electronic apparatus to provide the audio modulation featuresdescribed herein. If electronic device 100 is packaged as a stand alone "light management" chip, it could be configured to tap into any available analog audio port or node of the host product, whether in the transmit path, the receive path, or any internal audio signal path In this regard, electronic device 100 may include an input node 104 and one or more output nodes 106/108/110. Briefly, input node 104 is configured to receive an input audio signal for electronic device 100, and output nodes 106/108/110 are each configured to provide respective display element drive signals as output signals for electronic device 100. When electronic device 100 is deployed in an electronic apparatus such as a cellular telephone, the display element drive signals activate or otherwise drive respective display elements of the electronic apparatus.

Electronic device 100 generally includes a buffer amplifier 112, an audio-band filter 114, a half-wave rectifier 116, a voltage-to-current converter 118, a channel control element 120, and a driver circuit architecture 122. Some practical embodiments of electronic device 100 may also include an optional frequency conversion architecture and/or an optional time interleaving architecture (these optional features are individually and collectively identified by reference number 124 in FIG. 1, and together may be referred to as frequency and/or time shifters 124).

As mentioned above, an input audio signal 126 of the host electronic apparatus is present at input node 104. In the preferred practical embodiment, input node 104 represents a node that is internal to the host product. Input audio signal 126 may be an incoming voice signal, an outgoing voice signal, a ring tone, an alarm signal, a signal based upon an electronic audio file, a video game soundtrack, a signal based upon an external "line in" source, a signal obtained from a radio receiver, a microphone signal, a signal based upon or derived from any of these signals, or the like. Notably, input audio signal 126 represents a real-time audio signal of the host electronic apparatus. In other words, electronic device 100 processes input audio signal 126 simultaneously with the normal audible playback of input audio signal 126 by the host electronic apparatus. In practice, input audio signal 126 is an analog audio signal having a frequency band between approximately 20 Hz and approximately 20 kHz. In newer wideband audio applications, however, the upper frequency range may extend to approximately 48 kHz. Of course, these frequency ranges represent practical examples only, and the invention is not limited to any specific frequency range and/or signal level.

In the example embodiment, the input of buffer amplifier 112 is coupled to input node 104, and the output of buffer amplifier 112 is coupled to the input of audio-band filter 114 (possibly via frequency and/or time shifters 124). Buffer amplifier 112 may operate as a unity gain amplifier that makes input audio signal 126 available at the output of buffer amplifier 112. Buffer amplifier 112 operates in a conventional manner to isolate any loading effects of electronic device 100, which is desirable to ensure that electronic device 100 does not adversely impact the normal processing and transmission of the input audio signal by the host electronic apparatus.

If electronic device 100 includes frequency and/or time shifters 124, then a signal based upon or derived from input audio signal 126 serves as an input to frequency and/or time shifters 124 (as used herein, a signal Y that is "based upon or derived from" a signal X includes situations where signal Y is identical to, equivalent to, or indistinguishable from signal X; accordingly, the input to frequency and/or time shifters 124 may be input audio signal 126 itself). Briefly, frequency and/or time shifters 124 may be employed to shift a given input signal to different frequency bands to control different display element channels and/or to time-interleave frequency shifted signals derived from input audio signal 126 to drive different display element channels at different times. This time interleaving may be accomplished by clocking at a sufficient rate to give the impression of continuous real time coupling in each frequency band. Alternatively, smoothing may be accomplished with additional processing to interpolate or otherwise smooth adjacent time slotted drive signals. In other words, frequency and/or time shifters 124 may be suitably configured to provide additional levels of control and management over the modulation of the display elements. As depicted in FIG. 1, frequency and/or time shifters 124 generates a signal 128. A signal based upon or derived from signal 128 (which includes signal 128 itself) serves as an input to audio-band filter 114. The input to audio-band filter 114 is referred to herein as an analog audio signal, and signal 128 may be referred to herein as analog audio signal 128.

If electronic device 100 does not include frequency and/or time shifters 124, then a signal based upon or derived from input audio signal 126 (which includes input audio signal 126 itself) serves as an input to audio-band filter 114. In this regard, the input of audio-band filter 114 is coupled to input node 104 via buffer amplifier 112. As mentioned above, the input to audio-band filter 114 is referred to herein as an analog audio signal, and, in the context of this example, input audio signal 126 serves as the analog audio signal.

The analog audio signal 126/128 is filtered by audio-band filter 114 to generate a filtered audio signal 130 as an output. In this regard, filtered audio signal 130 is based upon analog audio signal 126/128. The specific filter characteristics of audio-band filter 114 (e.g., pass band, topology, order, cutoff frequency, roll-off slope, and the like) can be selected to suit the needs of the particular application. For example, one practical application employs a switched capacitor low pass filter having a 3 dB cutoff frequency of approximately 300 Hz. This particular audio-band filter 114 is compact in physical size, and it has relatively low power requirements, which can be important for portable device usage. The low cutoff frequency is desirable to facilitate modulation of display elements with bass tones found in music and video game soundtracks. An alternate embodiment may isolate high frequency treble tones in lieu of or in addition to the bass tones. Yet another alternate embodiment of electronic device 100 may include a plurality of audio-band filters 114 having different characteristics, or a dynamically tunable audio-band filter 114, to facilitate different modulation schemes that respond to different frequency bands.

In the preferred embodiment, the output of audio-band filter 114 is coupled to the input of half-wave rectifier 116. Half-wave rectifier 116 is suitably configured to half-wave rectify a signal based upon or derived from filtered audio signal 130 (which includes filtered audio signal 130 itself) to generate a half-wave rectified signal 132. In this regard, half-wave rectifier 116 generates half-wave rectified signal 132 based upon filtered audio signal 130. Half-wave rectified signal 132 is present at the output of half-wave rectifier 116. Half-wave rectifier 116 operates in a known manner to pass only the positive portion of its input signal or only the negative portion of its input signal. In practical embodiments, half-wave rectification is desirable to preserve the periodicity of the audio signal and to translate the variation in the audio signal level into visible display element fluctuations The output of half-wave rectifier 116 is coupled to the input of voltage-to-current converter 118. Voltage-to-current converter 118 is suitably configured to convert a signal based upon or derived from half-wave rectified signal 132 (which includes half-wave rectified signal 132 itself) into a drive current signal 134. In this regard, voltage-to-current converter 118 generates drive current signal 134 based upon half-wave rectified signal 132. Drive current signal 134 is present at the output of voltage-to-current converter 118, and drive current signal 134 is suitably configured to drive display elements of the host electronic apparatus or product (not shown in FIG. 1). In practical embodiments, voltage-to-current converter 118 is realized as a transconductance amplifier that generates drive current signal 134 such that the electrical current of drive current signal 134 increases with increasing amplitude of half-wave rectified signal 132 (and decreases with decreasing amplitude of half-wave rectified signal 132). The particular performance characteristics of voltage-to-current converter 118 can be selected to suit the needs of the given host product. Such characteristics may include, without limitation, the output current range and the sensitivity. In practice, a higher amplitude input audio signal (which translates to higher playback volume at the host apparatus) results in a higher voltage level for half-wave rectified signal 132, which results in a higher electrical current for drive current signal 134, which results in a brighter LED emission in embodiments that utilize LEDs for the display elements.

The output of voltage-to-current converter 118 is coupled to the input of channel control element 120. Channel control element 120 generally includes an input 136 for receiving a signal based upon or derived from drive current signal 134 (which includes drive current signal 134 itself), a plurality of outputs 138, and a control signal input 140 for receiving at least one control signal 142. Although only three outputs 138 are depicted in FIG. 1, a practical implementation of electronic device 100 may utilize any number of outputs 138. Channel control element 120 is suitably configured to selectively apply its input signal to outputs 138 in response to the at least one control signal 142. In other words, at any given time channel control element 120 makes its input signal available at one of its outputs 138, thus facilitating selective driving of the respective display elements of the host electronic apparatus. In practical embodiments, channel control element 120 may be realized as a digitally controlled switching component such as a multiplexer. As described in more detail below, the characteristics of the at least one control signal 142 may vary depending upon the specific application.

Outputs 138 of channel control element 120 are coupled to respective inputs of driver circuit architecture 122. To aid in this description, the input signals for driver circuit architecture 122 are identified as follows: signal 144 represents an input signal for a first driver circuit channel 146; signal 148 represents an input signal for a second driver circuit channel 150; and signal 152 represents an input signal for an N-th driver circuit channel 154. In accordance with one practical embodiment of the invention, outputs 138 are directly coupled to driver circuit architecture 122 such that signals 144/148/152 represent signal 134 as switched by channel control element 120. In alternate embodiments, signals 144/148/152 may represent respective signals that are based upon or derived from signal 134 (which includes signal 134 itself).

Driver circuit architecture 122 is configured to generate at least one display element drive signal based upon drive current signal 134. In the example embodiment shown in FIG. 1, driver circuit architecture 122 includes N driver circuit channels 146/150/154, which respectively generate N display element drive signals 156/158/160. Electronic device 100 makes display element drive signals 156/158/160 available at respective output nodes 106/108/110. In turn, output nodes 106/108/110 can be connected or coupled to respective display elements, such as LEDs, to allow display element drive signals 156/158/160 to activate the display elements.

Figure 2:
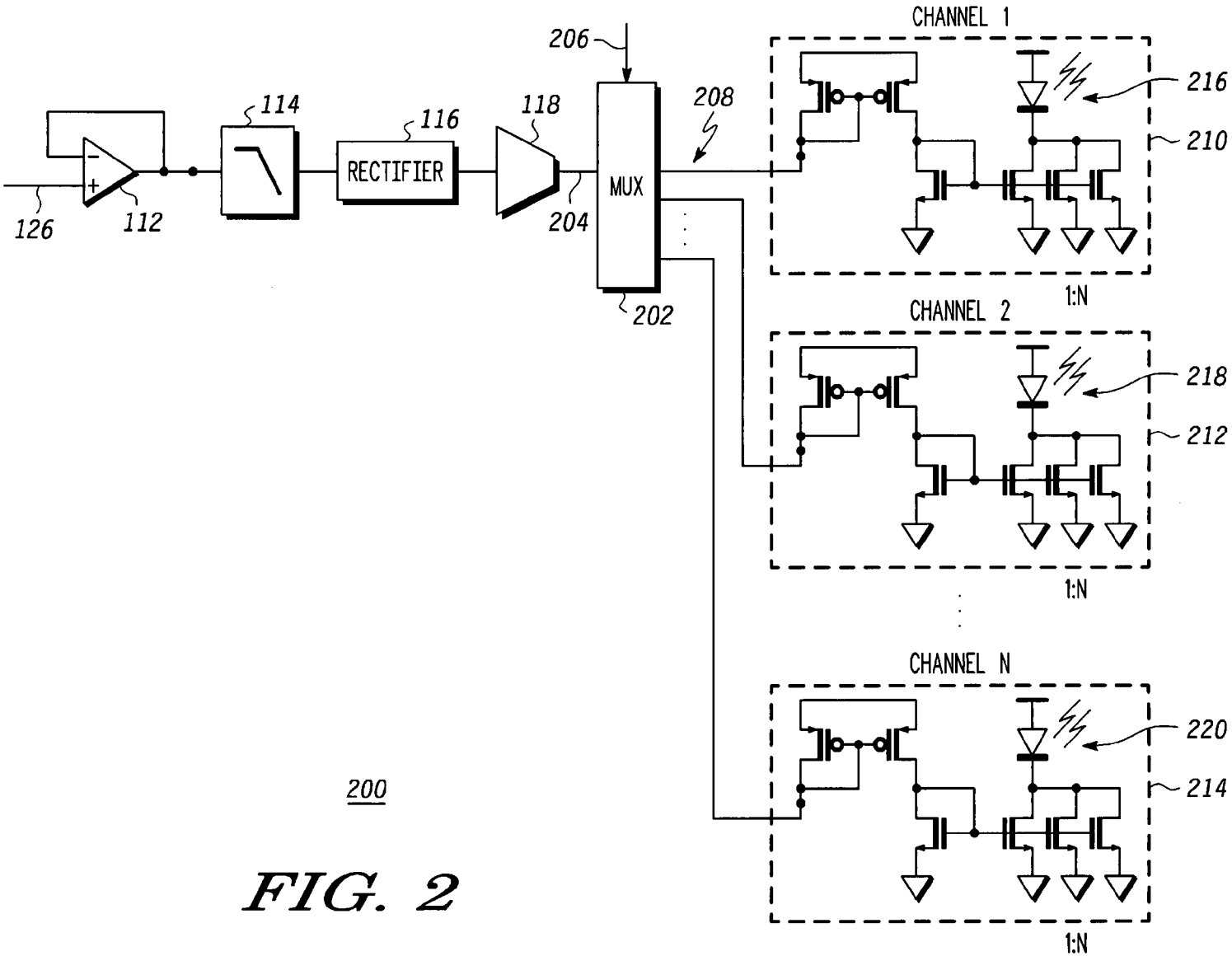
FIG. 2 is a schematic representation of a system for audio modulation of display elements, according to one practical embodiment of the invention.

FIG. 2 is a schematic representation of a system 200 for audio modulation of display elements, which is configured in accordance with one practical embodiment of the invention. Certain features and aspects of system 200 are similar to those described above in connection with electronic device 100, and shared features and aspects will not be redundantly described in the context of system 200. Notably, system 200 does not utilize a frequency conversion element, a time interleaving element, or a frequency and/or time shifter component as depicted in FIG. 1. In other words, the output of buffer amplifier 112 is coupled to audio-band filter 114 without an intervening frequency and/or time shifter component. Furthermore, system 200 employs a multiplexer 202 for the channel control element.

Generally, multiplexer 202 receives an input signal 204 that is based upon or derived from the drive current signal produced by voltage-to-current converter 118 (which includes the drive current signal itself). Multiplexer 202 also receives a control signal 206 that controls the operation of multiplexer 202. In practical embodiments, control signal 206 may be realized as a digital control signal having any bit length. In accordance with known techniques, multiplexer 202 directs input signal 204 to one of a plurality of outputs 208 in response to the current state of control signal 206. In this regard, multiplexer 202 can be digitally controlled using any number of suitable methodologies, including, without limitation: a state machine; a digital controller; counters; or switches. In addition, control signal 206 may be generated using any suitable control algorithm, whether simple or elaborate. For example, in the simple embodiment depicted in FIG. 2, system 200 only drives one display element at a time. In practice, however, the techniques described herein can be extended to more complex display architectures, which may utilize more than one multiplexer 202 and different control schemes to independently drive any number of display elements.

System 200 is arranged such that each output of multiplexer 202 is associated with a different display element channel 210/212/214. As mentioned above, a practical system 200 may include any number of display element channels, and the N-th display element channel 214 is intended to represent the potentially unlimited channel capability. System 200 preferably includes a display architecture that is configured to activate in response to the input signal 204. In practice, the display architecture can include any number of individual display elements. System 200 employs a plurality of LEDs 216/218/220 as the display elements. LEDs are well known components, and system 200 may utilize standard "off the shelf" LEDs that are suitable for the intended application. For example, system 200 may employ LEDs that emit different colors (white, red, green, yellow, blue, orange, etc.), and the specific physical and electrical specifications of the LEDs may vary from one application to another. In practice, specific LEDs may be selected by the manufacturer or designer of the host electronic apparatus, and the remaining portion of system 200 can be suitably designed to accommodate the selected LEDs.

Generally, each display element channel 210/212/214 includes suitably configured driver circuitry and a respective LED 216/218/220 that is driven by the driver circuitry. The topology and operation of each driver circuit are selected for compatibility with the electrical characteristics of the respective drive signals and the electrical characteristics and desired activation response of the LEDs. In this regard, system 200 (and the driver circuitry in particular) can be designed according to the selected LED operating requirements.

Figure 3:
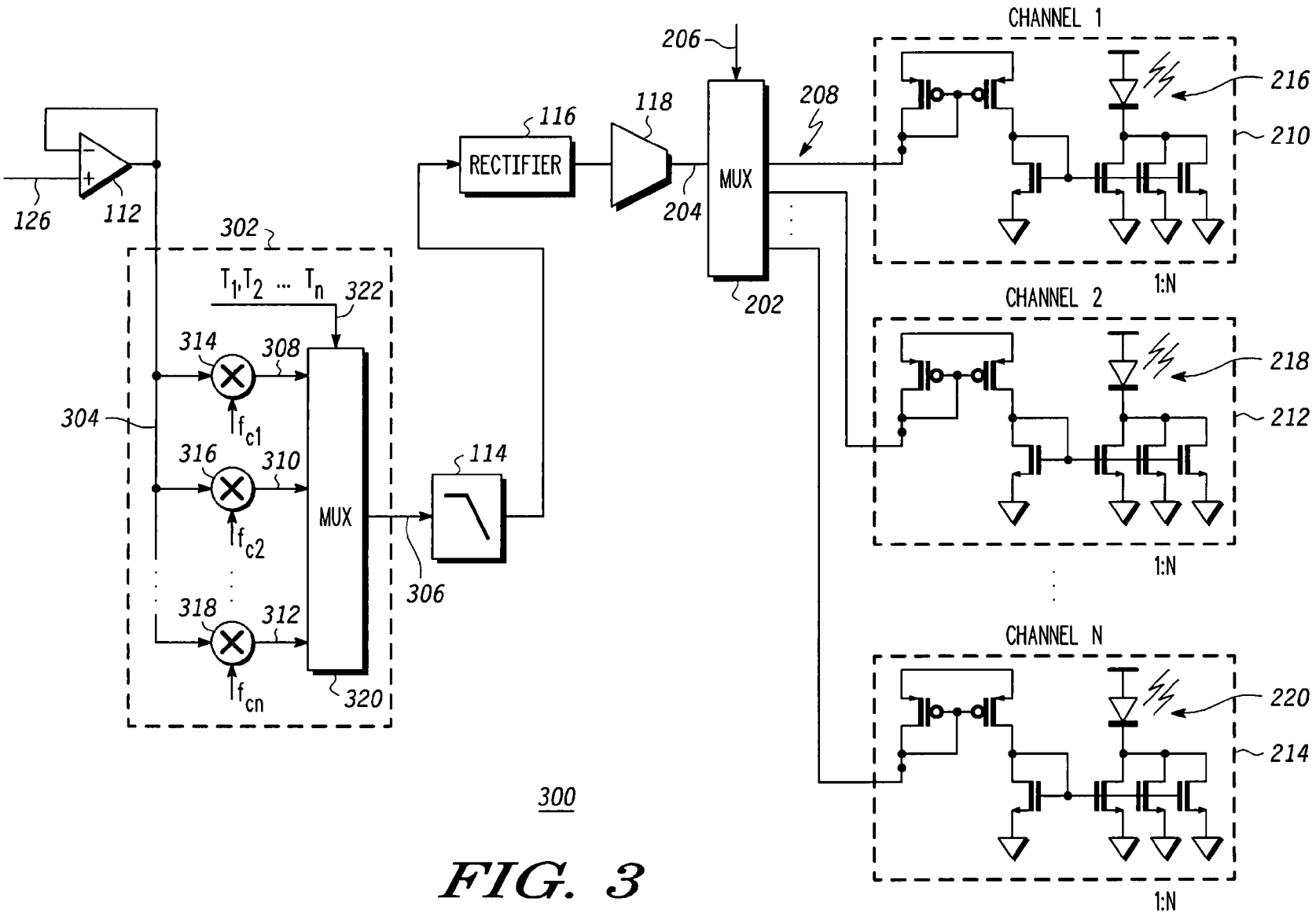
FIG. 3 is a schematic representation of a system for audio modulation of display elements, according to another practical embodiment of the invention.

FIG. 3 is a schematic representation of a system 300 for audio modulation of display elements, according to another practical embodiment of the invention. Certain features and aspects of system 300 are similar to those described above in connection with electronic device 100, and/or system 200, and shared features and aspects will not be redundantly described in the context of system 300. Notably, system 300 incorporates a combined architecture 302 that performs frequency conversion and time interleaving on a signal that is based upon or derived from input audio signal 126 (which includes input audio signal 126 itself). In this example embodiment, the input of combined architecture 302 is coupled to buffer amplifier 112 and the output of combined architecture 302 is coupled to audio-band filter 114. Generally, combined architecture 302 is configured to shift the frequency of its input signal 304 to generate a frequency shifted signal 306, which may be used as the input to audio-band filter 114. In particular, the frequency conversion portion of combined architecture 302 is configured to shift the frequency of its input signal 304 to generate a plurality of frequency shifted signals 308/310/312 (which are preferably shifted to different carrier frequencies), and the time interleaving portion of combined architecture 302 is configured to select one of the different frequency shifted signals 308/310/312 for use as frequency shifted signal 306. Another embodiment may utilize selective frequency binning through configurable filtering.

In the illustrated embodiment, the frequency conversion portion of combined architecture 302 is represented by a plurality of mixers 314/316/318, and the time interleaving portion of combined architecture 302 (which is coupled to the frequency conversion portion) is represented by a multiplexer 320. It should be appreciated that a practical embodiment can utilize any number of mixers, and that the arrangement shown in FIG. 3 is not intended to limit or otherwise restrict the scope of the invention in any way. As shown in FIG. 3, input signal 304 may serve as a common first input to mixers 314/316/318, and each mixer 314/316/318 preferably includes a respective second input corresponding to a different carrier frequency (identified by $f_{c1}$, $f_{c2}$, and $f_{cn}$, in FIG. 3). Following well known principles, each mixer 314/316/318 frequency shifts input signal 304 in accordance with the respective frequency of the second input. In practice, the frequency conversion portion may be configured to shift the frequency of input signal 304 to identify certain frequency bands and, therefore, to customize the lighting patterns to highlight those frequency bands. In addition, multiplexer 202 can control the activation of certain LEDs (e.g., LEDs of a specific color) such that specific frequency bands isolated by the frequency conversion portion result in the illumination of designated LEDs.

Generally, multiplexer 320 receives input signals that are based upon or derived from the frequency shifted signals 308/310/312 produced by mixers 314/316/318. Multiplexer 320 also receives a control signal 322 that controls the operation of multiplexer 320. In practical embodiments, control signal 322 may be realized as a digital control signal having any bit length. In accordance with known techniques, multiplexer 320 selects one of its input signals for use as its output; the selection is performed in response to the current state of control signal 322. In this regard, multiplexer 320 can be digitally controlled using any number of suitable methodologies, including, without limitation: a state machine; a digital controller; counters; or switches. In addition, control signal 322 may be generated using any suitable control algorithm, whether simple or elaborate. For purposes of time interleaving, control signal 322 samples the frequency shifted signals 308/310/312 at specific times (identified by $T_1$, $T_2$, and $T_n$, in FIG. 3). Of course, the timing of control signal 322 may be regular, random, erratic, dependent upon temporal characteristics of input audio signal 126, or otherwise designed to suit the needs of the particular host electronic apparatus.

In summary, systems, devices, and methods configured in accordance with example embodiments of the invention relate to:

A electronic device for audio signal modulation of display elements, said electronic device comprising: an audio-band filter configured to produce a filtered audio signal based upon an analog audio signal; a half-wave rectifier coupled to said audio-band filter, said half-wave rectifier being configured to generate a half-wave rectified signal based upon said filtered audio signal; and a voltage-to-current converter coupled to said half-wave rectifier, said voltage-to-current converter being configured to generate a drive current signal based upon said half-wave rectified signal, said drive current signal being configured to drive display elements of an electronic apparatus. The electronic device may further comprise a channel control element coupled to said voltage-to-current converter, said channel control element comprising: an input for receiving said drive current signal; a plurality of outputs; and a control signal input for receiving a control signal, said channel control element being configured to selectively apply said drive current signal to said plurality of outputs in response to said control signal. The electronic device may further comprise a driver circuit architecture coupled to said channel control element, said driver current architecture being configured to generate at least one display element drive signal based upon said drive current signal. The driver circuit architecture may comprise a plurality of driver circuit channels for a plurality of display elements, each of said driver circuit channels being configured to generate a display element drive signal based upon said drive current signal. The electronic device may further comprise a semiconductor substrate, wherein said audio-band filter, said half-wave rectifier, and said voltage-to-current converter are formed on said semiconductor substrate. The audio-band filter may comprise a switched capacitor filter. The electronic device may further comprise a frequency conversion architecture having an input for receiving an input audio signal, and an output coupled to an input of said audio-band filter, said frequency conversion architecture being configured to shift the frequency of said input audio signal to generate a frequency shifted signal for use as said analog audio signal. The electronic device may be configured such that: said frequency conversion architecture is configured to shift the frequency of said input audio signal to generate a plurality of frequency shifted signals; and said electronic device further comprises a time interleaving architecture coupled to said frequency conversion architecture, said time interleaving architecture being configured to select one of said plurality of frequency shifted signals for use as said analog audio signal.

A portable electronic apparatus comprising: an input node configured to provide an input audio signal; an audio-band filter having a filter output and a filter input coupled to said input node, said audio-band filter being configured to filter a first signal based upon said input audio signal to generate a filtered audio signal at said filter output; a half-wave rectifier having a rectifier output and a rectifier input coupled to said filter output, said half-wave rectifier being configured to half-wave rectify a second signal based upon said filtered audio signal to generate a half-wave rectified signal at said rectifier output; a voltage-to-current converter having a converter output and a converter input coupled to said rectifier output, said voltage-to-current converter being configured to convert a third signal based upon said half-wave rectified signal to generate a drive current signal at said converter output; and a display architecture configured to activate in response to said drive current signal. The portable electronic device may further comprise a driver circuit architecture coupled between said voltage-to-current converter and said display architecture, said driver circuit architecture being configured to generate at least one display element drive signal based upon said drive current signal. The display architecture may comprise a plurality of display elements, and said driver circuit architecture comprising a plurality of driver circuit channels for said plurality of display elements, each of said driver circuit channels being configured to generate a display element drive signal based upon said drive current signal. The display element architecture may comprise a light element. The light element may comprise an LED. The audio-band filter may comprise a switched capacitor filter.

A method for audio signal modulation of display elements, said method comprising: obtaining an analog audio signal of an electronic apparatus; filtering a first signal based upon said analog audio signal to produce a filtered signal; half-wave rectifying a second signal based upon said filtered signal to generate a half-wave rectified signal; and performing a voltage-to-current conversion on a third signal based upon said half-wave rectified signal to generate a drive current signal capable of driving display elements of the electronic apparatus. The method may further comprise: selectively applying a fourth signal based upon said drive current signal to one of a plurality of driver circuit channels for a plurality of display elements; and generating, with said one of a plurality of driver circuit channels, a display element drive signal in response to said fourth signal. The method may further comprise shifting the frequency of said analog audio signal to generate a frequency shifted signal for use as said first signal. The method may further comprise: shifting the frequency of said analog audio signal to generate a plurality of frequency shifted signals; and time interleaving said plurality of frequency shifted signals to select one of said plurality of frequency shifted signals for use as said analog audio signal.

While at least one example embodiment has been presented in the foregoing detailed description, it should be appreciated that a vast number of variations exist. It should also be appreciated that the example embodiment or embodiments described herein are not intended to limit the scope, applicability, or configuration of the invention in any way. Rather, the foregoing detailed description will provide those skilled in the art with a convenient road map for implementing the described embodiment or embodiments. It should be understood that various changes can be made in the function and arrangement of elements without departing from the scope of the invention as set forth in the appended claims and the legal equivalents thereof.

What is claimed is:

1. A electronic device for audio signal modulation of display elements, said electronic device comprising:

an audio-band filter configured to produce a filtered audio signal based upon an analog audio signal;

a rectifier coupled to said audio-band filter, said rectifier being configured to generate a rectified signal based upon said filtered audio signal; and a voltage-to-current converter coupled to said rectifier, said voltage-to-current converter being configured to generate a drive current signal based upon said rectified signal, said drive current signal being configured to drive display elements of an electronic apparatus.

2. An electronic device according to claim 1, further comprising a channel control element coupled to said voltage-to-current converter, said channel control element comprising:

an input for receiving said drive current signal;

a plurality of outputs; and a control signal input for receiving a control signal, said channel control element being configured to selectively apply said drive current signal to said plurality of outputs in response to said control signal.

3. An electronic device according to claim 2, further comprising a driver circuit architecture coupled to said channel control element, said driver circuit architecture being configured to generate at least one display element drive signal based upon said drive current signal.

4. An electronic device according to claim 3, said driver circuit architecture comprising a plurality of driver circuit channels for a plurality of display elements, each of said driver circuit channels being configured to generate a display element drive signal based upon said drive current signal.

5. An electronic device according to claim 1, further comprising a semiconductor substrate, wherein said audio-band filter, said rectifier, and said voltage-to-current converter are formed on said semiconductor substrate.

6. An electronic device according to claim 1, said audio-band filter comprising a switched capacitor filter.

7. An electronic device according to claim 1, further comprising a frequency conversion architecture having an input for receiving an input audio signal, and an output coupled to an input of said audio-band filter, said frequency conversion architecture being configured to shift a frequency of said input audio signal to generate a frequency shifted signal for use as said analog audio signal.

8. An electronic device according to claim 7, wherein:

said frequency conversion architecture is configured to shift the frequency of said input audio signal to generate a plurality of frequency shifted signals; and said electronic device further comprises a time interleaving architecture coupled to said frequency conversion architecture, said time interleaving architecture being configured to select one of said plurality of frequency shifted signals for use as said analog audio signal.

9. An electronic device according to claim 7, wherein said frequency conversion architecture achieves selective frequency binning through configurable filtering.

10. A portable electronic apparatus comprising:

an input node configured to provide an input audio signal;

an audio-band filter having a filter output and a filter input coupled to said input node, said audio-band filter being configured to filter a first signal based upon said input audio signal to generate a filtered audio signal at said filter output;

a rectifier having a rectifier output and a rectifier input coupled to said filter output, said rectifier being configured to rectify a second signal based upon said filtered audio signal to generate a rectified signal at said rectifier output;

a voltage-to-current converter having a converter output and a converter input coupled to said rectifier output, said voltage-to-current converter being configured to convert a third signal based upon said rectified signal to generate a drive current signal at said converter output; and a display architecture configured to activate in response to said drive current signal.

11. A portable electronic apparatus according to claim 10, further comprising a driver circuit architecture coupled between said voltage-to-current converter and said display architecture, said driver circuit architecture being configured to generate at least one display element drive signal based upon said drive current signal.

12. A portable electronic apparatus according to claim 11, said display architecture comprising a plurality of display elements, and said driver circuit architecture comprising a plurality of driver circuit channels for said plurality of display elements, each of said driver circuit channels being configured to generate a display element drive signal based upon said drive current signal.

13. A portable electronic apparatus according to claim 10, said display architecture comprising a light element.

14. A portable electronic apparatus according to claim 13, said light element comprising a light emitting diode ("LED").

15. A portable electronic apparatus according to claim 10, said audio-band filter comprising a switched capacitor filter.

16. A method for audio signal modulation of display elements, said method comprising:

obtaining an analog audio signal of an electronic apparatus;

filtering a first signal based upon said analog audio signal to produce a filtered signal;

rectifying a second signal based upon said filtered signal to generate a rectified signal; and performing a voltage-to-current conversion on a third signal based upon said rectified signal to generate a drive current signal capable of driving display elements of the electronic apparatus.

17. A method according to claim 16, further comprising:

selectively applying a fourth signal based upon said drive current signal to one of a plurality of driver circuit channels for a plurality of display elements; and generating, with said one of a plurality of driver circuit channels, a display element drive signal in response to said fourth signal.

18. A method according to claim 16, further comprising shifting the frequency of said analog audio signal to generate a frequency shifted signal for use as said first signal.

19. A method according to claim 18, further comprising:

shifting the frequency of said analog audio signal to generate a plurality of frequency shifted signals; and time interleaving said plurality of frequency shifted signals to select one of said plurality of frequency shifted signals for use as said analog audio signal.

* * * * *